US005623845A

United States Patent [19]

Wilde

[11] Patent Number: 5,623,845

[45] Date of Patent: Apr. 29, 1997

[54] METHOD FOR PRODUCING FLANGED STRUCTURAL PRODUCTS DIRECTLY FROM SLABS

[75] Inventor: William J. Wilde, Bath, Pa.

[73] Assignee: Bethlehem Steel Corporation

[21] Appl. No.: 383,120

[22] Filed: Feb. 2, 1995

Related U.S. Application Data

[63] Continuation-in-part of Ser. No. 86,074, Jul. 1, 1993, Pat. No. 5,386,869.

[51] Int. Cl.[6] ..... B21B 1/10

[52] U.S. Cl. ..... 72/225; 72/365.2

[58] Field of Search ..... 72/224, 225, 234, 72/365.2, 366.2

[56] References Cited

U.S. PATENT DOCUMENTS

| | | | |
|---|---|---|---|
| 4,966,026 | 10/1990 | Nishino | 72/224 |
| 5,152,164 | 10/1992 | Horiuchi et al. | 72/224 |
| 5,191,780 | 3/1993 | Ohmori et al. | 72/224 |
| 5,295,380 | 3/1994 | Hioki et al. | 72/224 |

*Primary Examiner*—Lowell A. Larson
*Assistant Examiner*—Thomas C. Schoeffler
*Attorney, Agent, or Firm*—Harold I. Masteller, Jr.

[57] ABSTRACT

Flanged structural products are rolled directly from rectangular slabs using only a universal mill having web rolls of fixed width corresponding to a selected finished web depth of the finished product. Original slab width is dependent upon the area ratio of the web and flanges in the intended finished product.

Flanged structural products are rolled directly from rectangular slabs using only a universal mill having web rolls of fixed width corresponding to a selected finished web depth of the finished product. Original slab width is dependent upon the area ratio of the web and flanges in the intended finished product. As the slab thickness is reduced between web rolls, flange rolls simultaneously apply pressure to the longitudinal edge surfaces of the slab, moving material toward the slab's center. The edge surfaces of the slab become upset in each pass so that the slab thickness at the edges exceeds the original slab thickness. As rolling proceeds, the web rolls are brought closer together as are the flange rolls. At every set point of these rolls, the cross section of the now deformed slab maintains a fixed ratio of areas between the web and the flanges, the same area ratio as in the finished product. The web and flange rolls are moved in precalculated increments until the slab takes on a finished wide flange shape, ready for use in the construction industry.

40 Claims, 4 Drawing Sheets

METHOD FOR PRODUCING FLANGED STRUCTURAL PRODUCTS DIRECTLY FROM SLABS

This application is a continuation-in-part of application Ser. No. 08/086,074 filed Jul. 1, 1993, now U.S. Pat. No. 5,386,869.

BACKGROUND OF THE INVENTION

The present invention relates to a method for producing ranged structural products, and more particularly to a method for producing structural beams, for example, beams having H and I shapes, directly from slabs.

Since the early years of the 20th century, when rolling ranged structural products as integral elements was first accomplished, there has been a constant need to save time, energy, and cost in the production of these products. The original production methods required a cast billet to be reheated and shaped into a flanged beam blank, for example, a general H shape, by rough shaping in a breakdown mill. The resultant blank was then finished in a universal mill. This method, which is described in U.S. Pat. No. 1,034,361, Jul. 30, 1912, by Grey, required both a breakdown mill and a universal mill.

As the rolled flanged products became widely used, more specific shapes, sizes, and weights of products were specified by the construction industry. The steel industry complied and today a wide variety of different rolled flanged products are produced in rolling mills throughout the world.

It became apparent that the cost of facilities, materials, and time might be reduced if a particular rectangular shape could be sent directly to the universal mill for rolling into a finished product. It was also recognized that if the rectangular shape could be sent directly to the universal mill, the breakdown mill could be eliminated, and facility and production costs would be reduced. In other words, it became an objective to produce flanged products by starting with a simple geometric cross section, e.g., a rectangular slab of metal, and accomplishing all of the shaping in a universal mill. Such slabs could come directly from a continuous caster as well known in the art, or the rolling method could start with cold slabs provided at the universal mill site.

To save energy, it is desirable that the slab, whether cold or coming directly from the caster, be brought up to rolling temperature only once during the process, prior to its entry to the universal mill. Also, it became an objective that a given slab cross section should be proportioned to enable finish rolling a large number of different finished products sizes or shapes with a minimum number of different rolls in the universal mill. And, in addition, the rolling should be accomplished with conventional horizontal and vertical rolls to allow for quick adjustment between the different product sizes.

As is apparent from the preceding discussion that feeding slabs directly into a universal mill eliminates the need for the breakdown mill and facilitates one-reheat processing of the metal.

One method for producing blanks for wide flange products from a rectangular slab is described in U.S. Pat. No. 4,420,961, Dec. 20, 1983, by Kusaba. Kusaba shows a rectangular slab being split along each of its longitudinal side edges. The slit is gradually deepened and widened to form a blank from which an H or I shape is produced after further separation of the split material of the edges to form flanges. The patent describes several other methods wherein a slab is formed into a blank for a finished product by slitting along the edges.

And, Kusaba discloses a method that requires only one reheat step during the rolling process from slab to finished product. However, in all cases, a separate breakdown mill is required to perform the splitting and shaping prior to entry into a universal mill. The yield rate of good product is affected by the apical angle of the slitting calibers, such that production of a suitable product with high production yield is not entirely predictable for new shapes.

SUMMARY OF THE INVENTION

Accordingly, it is an object of this invention to provide an improved method for producing flanged structural products directly from slabs of rectangular cross section.

It is a further object of this invention to provide an improved method for producing flanged structural products using a universal mill without preshaping of the metal in a breakdown mill.

It is yet another object of this invention to provide an improved method for producing flanged structural products wherein the set points for the horizontal and vertical rolls of a universal mill can be calculated in advance of actual operation with predictable results.

It is still another object of this invention to provide an improved method for producing wide flange products which reduces the rolling time from blank to finished product thereby enabling a one-reheat process.

Still other objects and advantages of this invention will be obvious and apparent from the specification.

I have discovered that the foregoing objects can be attained using a method for producing from a slab, a finished flanged product having a predetermined web to flange area ratio $A_w/A_f$. The method comprises the steps of; providing a slab having a cross section with a predetermined depth $d_s$ and a thickness $t_s$: compressing the slab thickness $t_s$ to an intermediate thickness $t_n$ between a set of opposed web rolls having a roll width equal to a web depth $d_w$ of the finished flanged product; compressing substantially concurrently with the step compressing the slab thickness $t_n$, portions of the slab depth $d_s$ not compressed by the set of opposed web rolls, the portions of the slab depth $d_s$ being compressed to an intermediate depth $d_n$ by at least one flange roll; adjusting incrementally at least one web roll in a direction to further reduce the thickness $t_n$; adjusting incrementally at least one flange roll in a direction to further reduce the depth $d_n$; further compressing the slab with the web rolls and at least one flange roll to incrementally further reduce the intermediate thickness $t_n$ and intermediate depth $d_n$; and repeating the adjusting and compressing process until the intermediate thickness $t_n$ and the intermediate depth $d_n$ have a web to flange area ratio $A_{wn}/A_{fn}$ equal to the predetermined web to flange area ratio $A_w/A_f$ of the finished flanged product, and the web and flange thicknesses are equal to those of the predetermined finished product.

Accordingly, the invention comprises the several steps and the relation of one or more of such steps with respect to each of the others thereof, which will be exemplified in the method hereinafter disclosed, and the scope of the invention will be indicated in the claims.

DESCRIPTION OF A PREFERRED EMBODIMENT

The method for producing flanged structural products directly from slabs in accordance with the present invention employs only a universal mill having driven horizontal or web rolls, and unpowered vertical or flange rolls that are adjustably spaced apart. The web rolls are of a fixed width corresponding to the web depth $d_w$ of a selected finished flanged product. The dimensions of the slab are predetermined and based upon the dimensions of the finished flanged product to be produced. In particular, the slab depth $d_s$ is dependent upon the ratio of the web area to the flange area in the finished product.

In the roll passes, the web rolls having a width corresponding to the finished web depth $d_w$, press on the slab. The slab has a depth $d_s$ greater than the finished web depth, and its thickness $t_s$ is reduced between the web rolls. Simultaneously, the flange rolls apply pressure to the longitudinal edge surfaces of the slab, moving material, which has not been compressed by the web rolls, toward the slab center. Repeated passes between the rolls causes the edge surfaces of the slab to become upset so that the slab thickness at the edges exceeds the in process slab thickness at the central portion, where the web rolls are operating.

As the rolling proceeds, the rolls are brought closer and closer together. At every set point of the rolls the cross section of the now deformed slab maintains a fixed ratio between the areas of web and the flanges, the same web/flange area ratio as in the finished product. The horizontal and vertical rolls are moved in precalculated increments until the slab takes on a finished ranged shape, ready for use in the construction industry.

Figure 1:
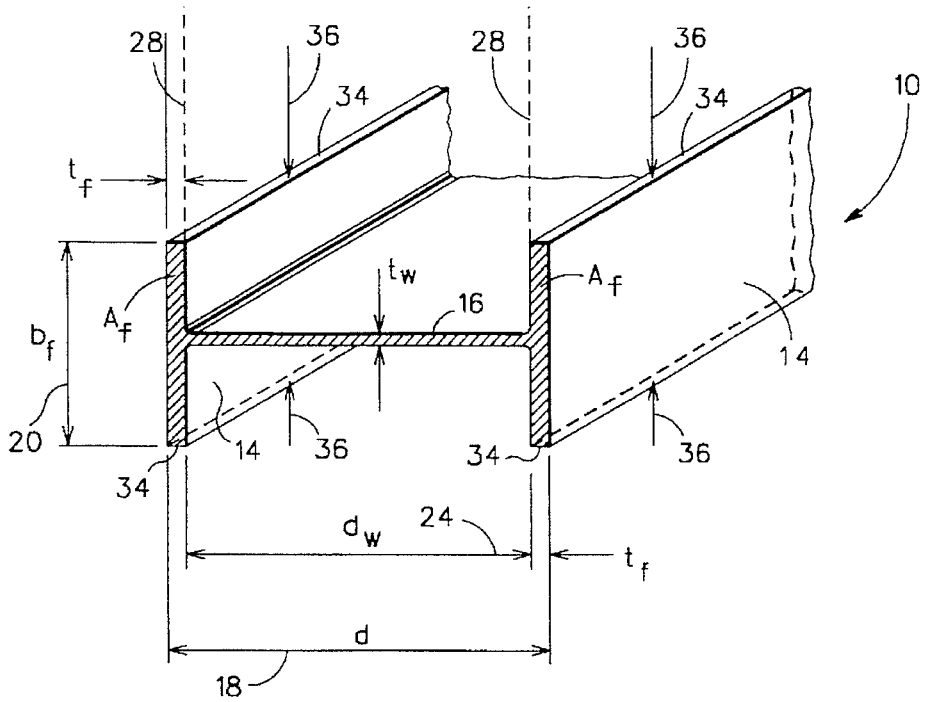
FIG. 1 is an oblique view of a finished H-shape flanged beam product.
Figure 2:
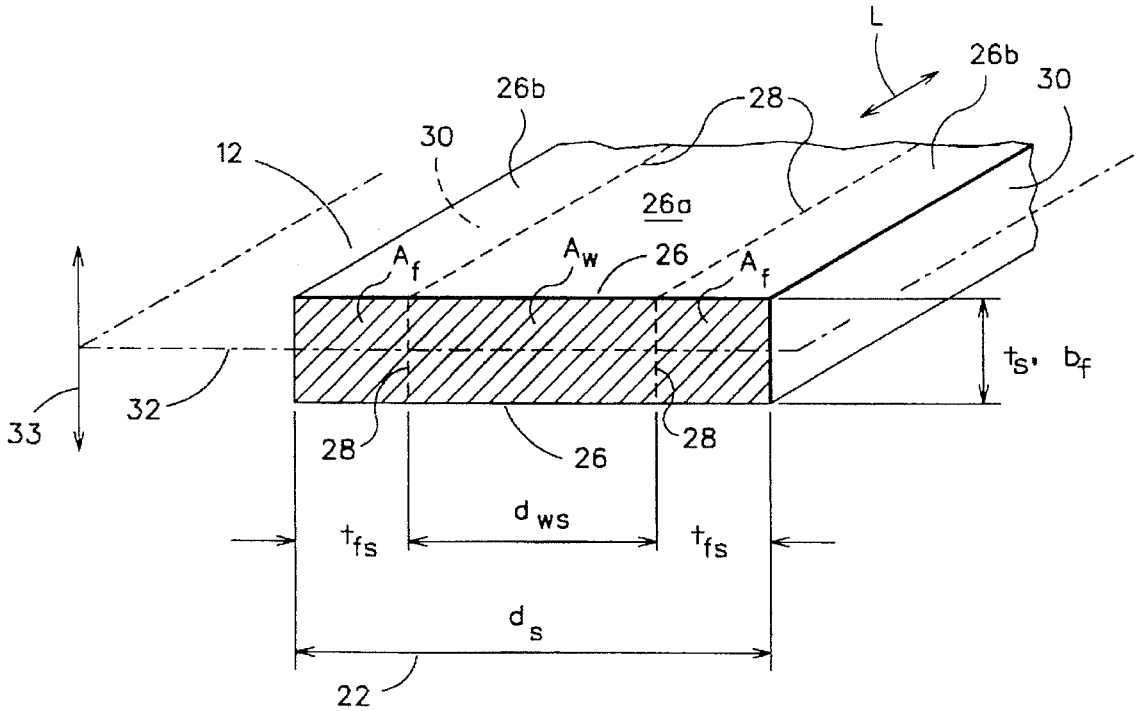
FIG. 2 is an oblique view of a rectangular slab used in accordance with the method of the present invention to produce the finished H-shape flanged beam product of FIG. 1.

Referring to FIGS. 1 and 2, a structural ranged product 10 is produced by the method in accordance with the present invention from a slab 12 having a cross section as illustrated in FIG. 2. The ranged product 10 can be of any known size or shape in the art, all of which can be manufactured by rolling in a universal mill using the method in accordance with the present invention.

Figure 6:
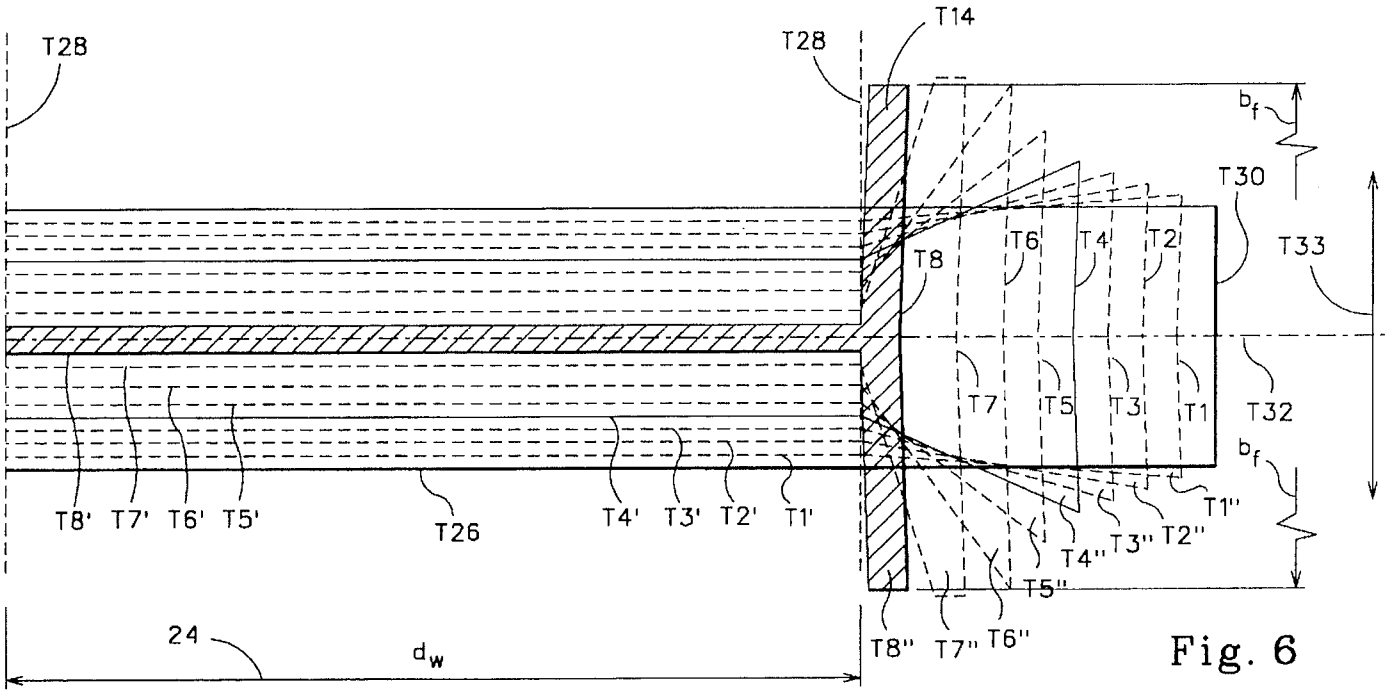
FIG. 6 is an end view showing stages of deformation from the slab of FIG. 5 to a finished T-shape flanged product in accordance with the method of the present invention.
Figure 8:
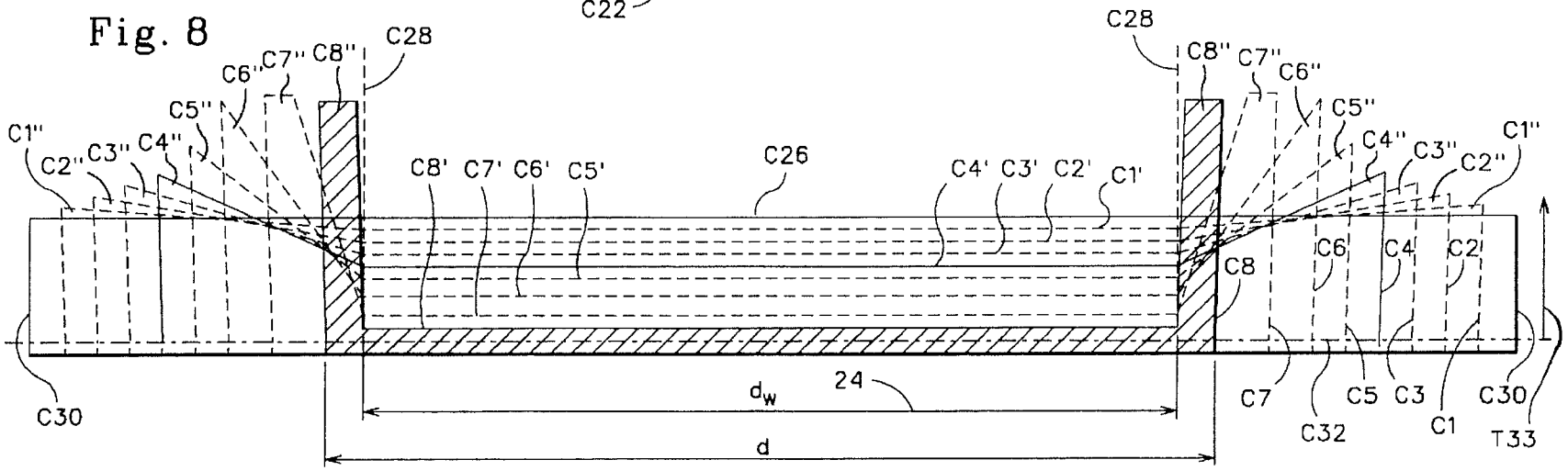
FIG. 8 is an end view showing stages of deformation from the slab of FIG. 7 to a finished C-shape flanged product in accordance with the method of the present invention.

For example, FIG. 1 shows a structural wide flange beam or H-beam product while FIGS. 6 and 8 show a T-shape ranged product and a channel or C-shape ranged product respectively. The product 10 of FIG. 1 includes a pair of flanges 14 connected by a central web 16. Beam product 10 has an overall depth 18 measured along the web direction and identified with the letter d, and a flange width 20 identified with the letters $b_f$. Beam product 10 is also shown having a flange thickness $t_f$ and a web thickness $t_w$.

The beam product 10 is produced from slab 12 having a selected slab length L, thickness $t_s$ and depth 22, also identified with an original depth value $d_s$ in FIG. 2. The length L of the slab may vary, but is dependent upon the caster, cutter, reheat furnace, and length limitations at the facility where the ranged structural product is produced.

In accordance with the invention, slab 12 is reheated to a rolling temperature in a reheat furnace prior to its insertion into a universal mill (not shown). The universal mill includes horizontal web rolls corresponding to the finished web depth 24 of the selected finished beam web 16. The web rolls work the upper and lower surfaces **26*a* of the slab 12 in the central region defined between the broken lines 28. At the same time, the flange rolls of the universal mill work the opposite edge surfaces 30 of slab 12. As stated, the web rolls and flange rolls of the universal mill act simultaneously, and the rotating axis of each of the associated web and flange rolls lies in a common plane, which is perpendicular to the upper and lower slab surfaces 26**.

Thus, the central portion **26*a* of the slab, defined between the broken lines 28, is compressed to an intermediate thickness $t_n$ less than the original slab thickness $t_s$, and at the same time the slab is reduced in its depth 22** from the original value $d_s$ to a new value $d_n$.

As the method proceeds, the spacing between the web rolls is reduced incrementally in steps n so that the intermediate slab thickness $t_n$ at its central portion **26*a* is further reduced from the initial value $t_s$. For every incremental change in spacing between the web rolls, the flange rolls are also brought closer together incrementally such that the width 22** is further reduced from its original value $d_s$.

As the slab 12 is passed back and forth between the web and flange rolls, hot metal in area **26*b*, located in the regions extending between the broken lines 28 and the outside edge surfaces 30, is forced to move in opposite directions away from the center plane 32 of the slab. As shown by arrow 33, the hot metal is forced in a direction so that the flange width $b_f$ of the slab area 26*b***, at the outer slab extremities, exceeds the in process slab web thickness $t_n$.

The web and flange rolls are further incrementally repositioned until the rolls produce a finished product having a web thickness $t_w$, a flange thickness $t_f$, a flange width $b_f$, and a depth d as shown in FIG. 1. Edging rolls (not shown) are used in later rolling stages to bring the flange width 20 to the desired final value $b_f$. The edging rolls press on the flange tips 34 in opposite directions, as indicated by the arrows 36, which are parallel to the forces exerted by the web rolls.

Figure 3:
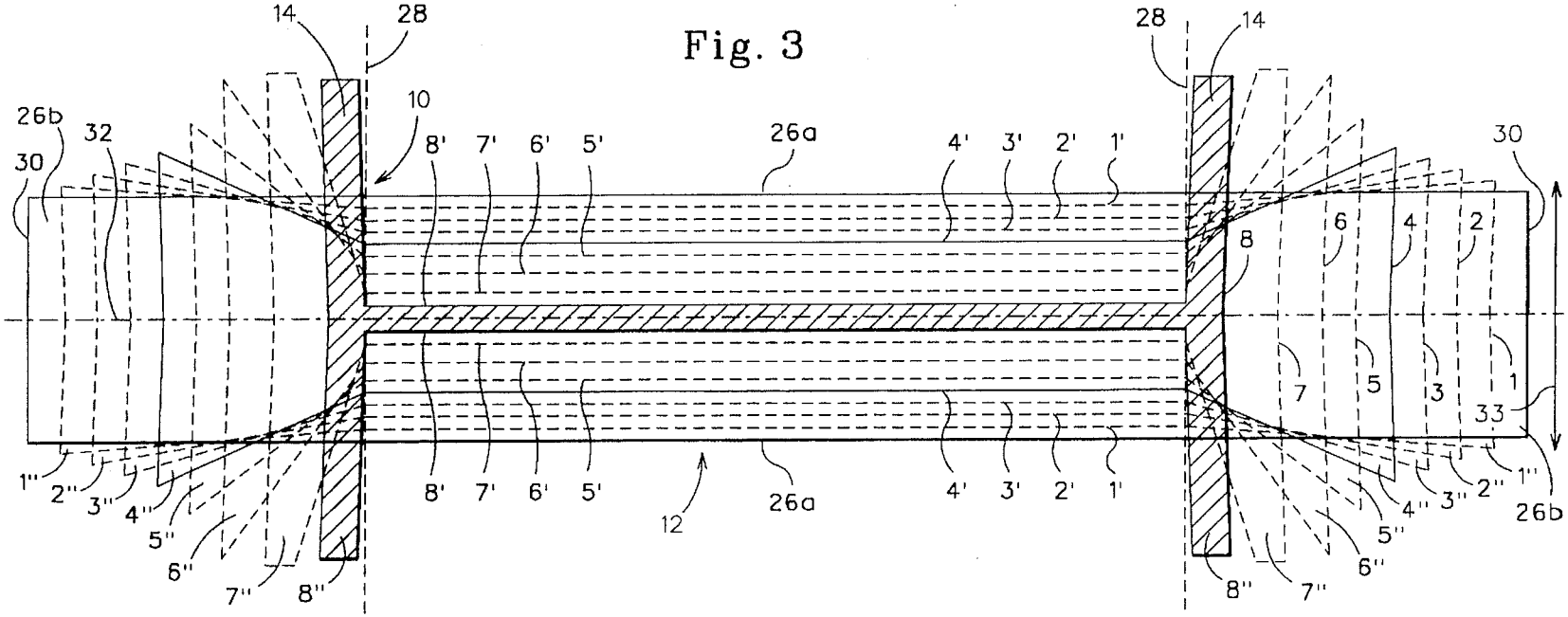
FIG. 3 is an end view showing stages of deformation from the slab of FIG. 2 to a finished H-shape flanged product in accordance with the method of the present invention.

FIG. 3 illustrates nine incremental roll adjustments or steps used to produce the H-shape flanged product shown in FIG. 1. This is only one of many possible examples. For other sizes and shapes of finished flanged products, and for different mill facilities, the number of incremental steps may be greater or less than illustrated. The draft (distance) between set points of the rolls is generally limited by the energy available in the mill where the shape is rolled.

After each of the nine incremental steps, the opposite edge surfaces 30 of the slab 12 have been moved by compression of the slab to the positions indicated in FIG. 3 by the digits 1–8. Simultaneously, the upper and lower opposed surfaces **26*a* within the region determined by the width of the web rolls and defined in the figure by the broken lines 28, are compressed correspondingly to the dimensions illustrated in FIG. 3 by the numerals 1'–8' respectively. The rolling actions are symmetrical on both edge surfaces 30, and on the upper and lower surfaces 26***a*. As the shaping progresses and the depth dimension 22 of the slab is decreased from the original dimension $d_s$, hot material moves vertically in two directions away from the slab center plane 32 as shown by directional arrow 33. Thus, the final contours of the flanges 14 are formed in incremental steps corresponding to the set points of the web and flange rolls which increasingly displace the incremental flange areas 1"–8" shown in FIG. 3. The slab 12 makes a single pass through the rolls at each set point, and nine passes are made in the cited example.

After the nine illustrated passes are made between each roll set point, an H-shape as shown in FIGS. 1 and 3 is produced from the slab 12. The last set point for the web and flange rolls produces a finished web thickness $t_w$, a finished flange thickness $t_f$, and edging rolls (not shown) produce a finished flange width 20 having a value $b_f$. The depth 18 of the finished structural member is defined by the width of the web rolls (not shown) that formed the web and by the thickness of the flanges.

Because the flange and the web portions are worked simultaneously, asymmetrical effects which reduce product yield, e.g. tongues and fins produced in bloomer/breakdown mill rolling operations, are mostly avoided, and only a small amount of yield loss is encountered. The resultant product is ready for use by a fabricator as a constructional element. However, "polishing" without dimensional changes of the inside and outside surfaces, but not the flange tops 34, may follow before delivery of the product.

Edging, particularly in early stages, may be accomplished using flat or cone shaped edger rolls to control localized flange spreading adjacent to the flange roll working surfaces. The flat edger roll may be used in addition to or in place of a separate edger roll for a finishing mill.

Success of the above described method and high yields of produced product, with low defect rate and without need for reheating during the rolling process, result from commencement of the rolling at the universal mill with a properly dimensioned slab.

In accordance with the present method, each finished product is associated with a slab of particular cross sectional area and rectangular shape. Each incremental step or set point of the web and flange rolls of the universal mill is precalculated, such that the area ratio between the web and the flanges of the slab being manufactured in the mill, remains the same at each step as the area ratio of the web to the flanges in the finished product. The product 10 in FIG. 1 is symmetrical. Therefore, an area ratio may be based on calculations including one or both flanges. However, in the case of an asymmetrical shape such as the T-shape shown in FIG. 6, the area ratio is based upon a single flange. The equations below are based on the web area and a single flange area.

Figure 4:
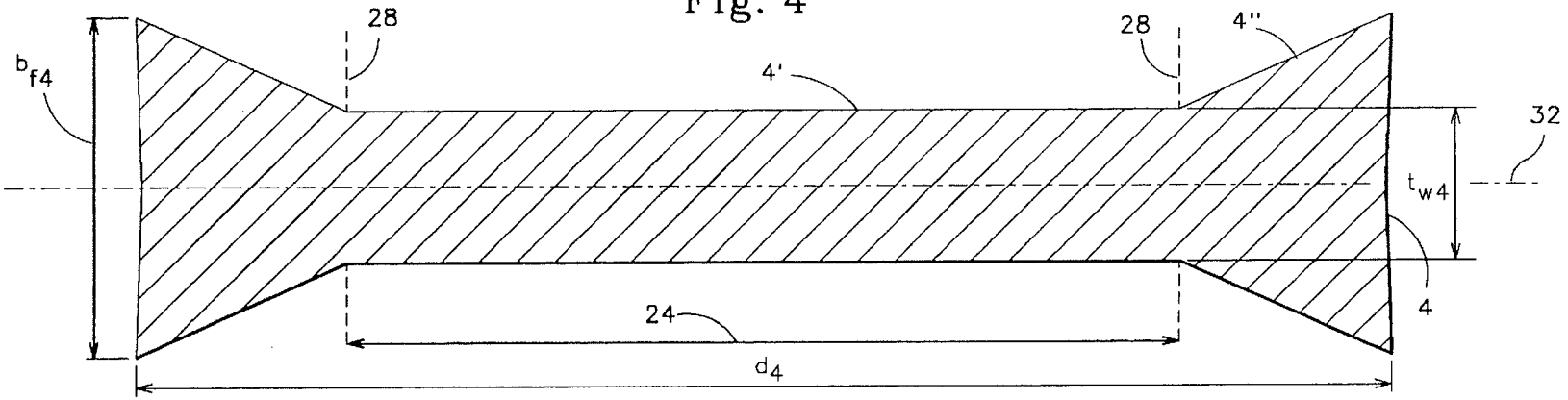
FIG. 4 is a view similar to FIG. 3, showing the deformation of the slab at an exemplary fourth set point of the horizontal and vertical universal mill rolls used in accordance with the method of the present invention.

FIG. 4 is an end view of slab 12 showing the fourth set point position where the web rolls are at the set point 4' and the flange rolls are at their set point 4. It can be seen that the cross sectional areas are basically portions of rectangles and truncated triangles. Therefore, the cross sectional area of the web 16 and the cross sectional area of those portions which ultimately become the flanges 14, are readily calculated before the rolling process begins. The number of steps used in rolling a flanged product 10 from a slab 12 depends upon the energy available in the rolls and the draft that is thereby permitted in adjusting the distance between roll set-points for each step. In FIG. 4, the truncated triangular portions become the flanges in the finished product. It will be understood by those skilled in the art that the slab increases along its length L as it is worked simultaneously vertically and horizontally by the rolls of the universal mill.

Thus, it is possible, by using the known dimensions of the geometry of the selected finished flanged product 10, and by performing calculations, to determine the starting slab depth $d_s$. Then, based upon the physical capability of the universal mill that is to be used, the number of steps or set points to be used in forming the finished product is determined. It is possible to calculate the interim values $d_n$ and corresponding interim values $t_n$ as these dimensions are worked from $d_s$ to d and $t_s$ to $t_w$, respectively. Each corresponding respective step n, (n+1, n+2 . . . ) of the web and flange rolls is calculated such that the web area to flange area ratio $A_{wn}/A_{fn}$ of the slab is always the same as the web area to flange area ratio $A_w/A_f$ of the selected finished product. This calculation is made as accurately as possible.

Briefly stated, the method comprises the steps of selecting the proper slab cross section, in particular the slab depth 22 in consideration of the slab thickness $t_s$ that is produced or provided at a particular rolling facility. Stated otherwise, slab thickness is not a variable that is fully selectable in using the method in accordance with the invention. The slab generator or source, i.e. continuous caster, determines $t_s$. The slab thickness $t_s$ should generally be at least four times the finished web thickness $t_w$, and ideally $\geqq b_f$ of the selected finished product.

Then, tables of corresponding set points are calculated for the web rolls, flange rolls and in the later stages for edge rolls that limit flange width 20, so that the area of the web during the rolling process bears the same ratio to the area of the flanges during the rolling process as does the area ratio of the web to the flanges in the finished product.

Then, with the table of precalculated set points, the slab, at an elevated temperature, e.g., 2200° F., is processed in the universal mill, making a pass of the slab at each of the corresponding set points for the rolls until, after the pass at the final set points, there is a completed ranged product. At this time the member has cooled down, for example, to 1400° F.

In most existing universal mills the horizontal web rolls, but not the vertical flange rolls, are driven. Preferably both roll pairs are driven. It should be understood that the subject method is independent of orientation. In the method of the invention, the rolls and slab can be oriented to produce a member with the web oriented vertically.

The following example is based upon the specifications for a W24L×62 wide flange beam as listed in "*Bethlehem STRUCTURAL SHAPES*", Catalog 3277, June 1989, and reference to the dimensional symbols are shown in FIGS. 1 through 4 of the drawings for this application. The steps of the method to produce the finished H-shape ranged product 10 of FIG. 1 are as follows.

Step 1) Calculate the web area to flange area ratio $A_w/A_f$ of the finished flanged product 10. (See FIG. 1.)

$$A_w = (d - 2t_f)(t_w) \qquad A_f = b_f t_f$$

$$A_w = [23.74 - (2 \cdot 0.590)]\,(0.430) \qquad A_f = (7.040)\,(.590)$$

$$A_w = 9.701 \qquad A_f = 4.154$$

$$A_w A_f = 2.336$$

Step 2) Calculate the slab starting width $d_s$, shown as reference number 22, using the following equation, recognizing that the slab thickness $t_s$ is a known value for a particular casting facility. The thickness $t_s$ should be $\geqq 4t_w$ of the finished product, and ideally $\geqq b_f$. (See FIG. 2.)

$$d_s = d_{ws} + 2t_{fs}$$

$$t_s = 8 \quad \therefore\ d_s = (d - 2t_f)\,[1 + 2\,(A_w/A_f)^{-1}]$$

$$d_s = (23.740 - 2 \cdot 0.590)\,[1 + 2\,(2.336)^{-1}]$$

$$d_s = (22.560)\,[1 + 2\,(2.336)^{-1}]$$

$$d_s = 22.560 + 45.120\,(2.336)^{-1}$$

$$d_s = 22.560 + 19.319 = 41.879$$

This equation establishes a starting web area between the broken lines 28, and the starting flange areas extending between the broken lines 28 and the edge surfaces 30. For example, knowing that $d_{ws}$=22.560 and $t_{fs}$=22.426, the starting web area to flange area ratio, $A_{ws}/A_{fs}$ is calculated as follows.

$$A_{ws} = (d_{ws})\,(t_s) \qquad A_{fs} = (t_{fs})\,(b_{fs})$$

$$A_{ws} = (22.560)\,(8) \qquad A_{fs} = (9.660)\,(8)$$

$$A_{ws} = 180.480 \qquad A_{fs} = 77.276$$

$$A_{ws}/A_{fs} = 180.480/77.276 = 2.336$$

As can be seen by the example, the starting depth 22 of the slab is adjusted to provide a starting web area to flange area ratio $A_{ws}/A_{fs}$ equal to the finished product $A_w/A_f$ ratio shown in Step 1. Therefore, the starting slab ratio equals the finished $A_w/A_f$ ratio regardless of the value of the slab thickness $t_s$.

Step 3) Calculate a standard set point table for each pass between the web rolls of the universal mill. Each pass reduces the thickness $t_s$ of the slab by a step (n+1 . . . n+8), until a thickness $t_w$ of the desired finished flanged product is reached. (See FIG. 3 and Table A below.)

Web Draft=$(t_s - t_w)/n$

Web Draft=(8−0.430)/9

Web Draft=0.841

The number of passes and the draft at each pass is made consistent with power available in the mill, and product grade/temperature requirements as known in the art.

Step 4) Calculate the intermediate web area $A_{wn}$ at each selected horizontal set point (n+1 . . . n+8), using the following equation. The following example is based on set point n+4. (See FIG. 4 and Table A below.)

$$A_{w4} = (t_{w4})\,(d_w)$$

$$A_{w4} = (4.636)\,(22.560)$$

$$A_{w4} = 104.578$$

Step 5) Calculate the intermediate flange area $A_{fn}$ for each horizontal set point (n+1 . . . n+8), using the following equation. The following example is based on set point n+4. (See FIG. 4 and Table A below.)

$$A_{f4} = A_{w4}\,(A_w/A_f)^{-1}$$

$$A_{f4} = 104.578\,(2.336)^{-1}$$

$$A_{f4} = 44.7686$$

Step 6) Calculate a table of intermediate flange widths $b_{fn}$ for each pass (n+1 . . . n+8), from slab thickness $t_s$ to flange width $b_f$ of the finished product 10; and Step 7) Calculate a set point table for the flange rolls for each step (n+1 . . . n+8) by dividing the $A_{fn}$ by the $b_{fn}$ for each pass.

| Step 6 | Step 7 |
|---|---|
| $b_{fm} = (t_s - b_f)/n$ | $t_{f4} = A_{f4}/b_{f4}$ |
| $b_{fm} = (8 - 7.040)/9$ | $t_{f4} = 39.53/7.888$ |
| $b_{fm} = 0.107$ change each set point. | $t_{f4} = 5.011$ |
| $\therefore\ b_{f4} = 8 - (0.107 \times 4)$ | |
| $b_{f4} = 7.573$ | |

The following Table A illustrates the above 7-Step roll set point information calculated to produce a W24L×62 wide flange beam rolled from slab to finished ranged product in nine passes.

TABLE A

| | W24L×62 WIDE FLANGE BEAM | | | | | | | |
|---|---|---|---|---|---|---|---|---|
| PASS OR STEP | $d_n$ | $d_{wn}$ | $t_{wn}$ | $b_{fn}$ | $t_{fn}$ | $A_{wn}$ | $A_{fn}$ | $A_{wn}A_{fn}$ |
| SLAB n | 44.879 | 22.560 | 8.000 | 8.000 | 9.658 | 180.480 | 77.260 | 2.336 |
| n + 1 | 40.079 | 22.560 | 7.159 | 7.893 | 8.759 | 161.507 | 69.138 | 2.336 |
| n + 2 | 38.231 | 22.560 | 6.318 | 7.787 | 7.836 | 142.534 | 61.016 | 2.336 |
| n + 3 | 36.335 | 22.560 | 5.477 | 7.680 | 6.887 | 123.561 | 52.894 | 2.336 |
| n + 4 | 34.384 | 22.560 | 4.636 | 7.573 | 5.912 | 104.588 | 44.772 | 2.336 |
| n + 5 | 32.374 | 22.560 | 3.794 | 7.467 | 4.907 | 85.953 | 36.641 | 2.336 |
| n + 6 | 30.310 | 22.560 | 2.953 | 7.360 | 3.875 | 66.620 | 28.519 | 2.336 |
| n + 7 | 28.184 | 22.560 | 2.112 | 7.253 | 2.812 | 47.647 | 20.397 | 2.336 |
| n + 8 | 25.995 | 22.560 | 1.271 | 7.146 | 1.718 | 28.674 | 12.275 | 2.336 |
| n + 9 | 23.740 | 22.560 | 0.430 | 7.140 | 0.590 | 9.701 | 4.153 | 2.336 |

The slab 12 is then fed into a universal mill having its web and flange rolls positioned according to the above calculated set-points shown in Table A. The slab 12 is then rolled in a series of passes according to the n sets of set points, and the wide flange product 10 shown in FIG. 1 is the resultant output when the passes have been completed. The finished products are completed without additional reheating after a heated slab, e.g., from a continuous casting process, has entered the mill for rolling.

It is not unusual for each beam size in a family of beam products to have the same inside web depth $d_w$. For example, in the Bethlehem W24 wide flange family, twelve different weight beams fall within a range of sizes from the smallest W24×55 beam to the largest W24×176 beam. Each of the twelve different W24 beams have the same 22.560" wet depth $d_w$. Such beam families can be rolled into finished products using the same web and flange rolls in the universal mill.

Some universal mills have tapered flange rolls. In such mills the outer surface of the slab's web portion may develop a slight concavity along a central plane 32, as illustrated in FIGS. 3 and 4. This contoured flange portion should be taken into consideration when calculating area ratios between the web and the flanges for the various set-points of the rolling method.

Although the above example shows using the steps of the present invention to produce a finished wide flange beam product, it should be understood that other ranged products may be produced using the steps of the method. For example, FIGS. 5 and 6 show producing a ranged structural T-shape using the present rolling method invention.

Figure 5:
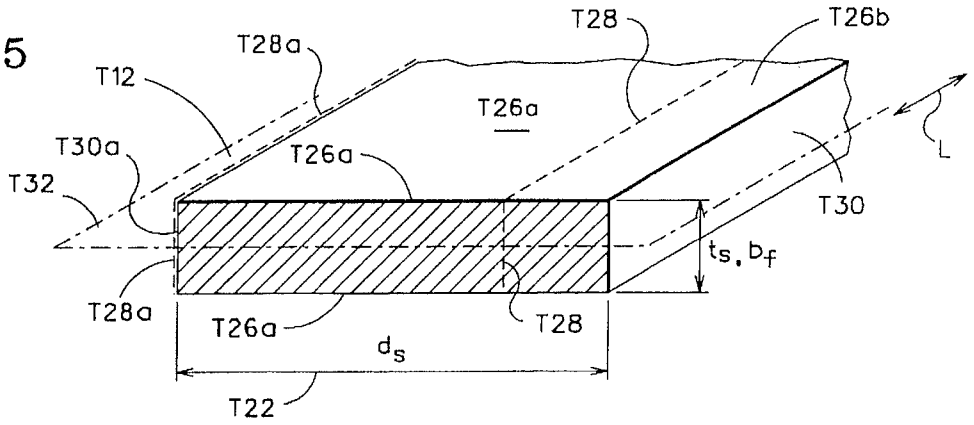
FIG. 5 is an oblique view similar to FIG. 2 showing a rectangular slab used in accordance with the method of the present invention to produce a finished T-shape flanged product.

As in the above ranged beam example, the T-shape product is produced from a slab T12 having a selected slab length L, thickness $t_s$, and depth T22 also identified with an original slab depth value $d_s$ in FIG. 5.

As before, slab T12 is reheated to a proper rolling temperature prior to its insertion into a universal mill. The universal mill includes horizontal web rolls corresponding to the finished web depth $d_w$ of the T-shape product. The web rolls work the upper and lower surfaces **T26*a* of the slab T12 in the web region defined between the broken line T28*a*, extending along one edge of slab T12, and a second broken line T28. At the same time a vertical flange roll works the slab edge surface T30 adjacent broken line T28, and an edger roll, (not shown) works edge T30*a* to control localized hot material squeeze out along edge T30*a*, and maintain a proper web depth dw between the broken lines T28*a* and T28. The web portion of the slab, defined between the broken lines T28*a* and T28, is compressed to an intermediate thickness less than the original slab thickness $t_s$, and at the same time the slab is reduced in its depth T22** from the original slab depth value $d_s$.

As the method proceeds, the spacing between the web rolls is reduced incrementally in steps n so that the intermediate slab thickness $t_n$ at its central portion is further reduced from the initial value $t_s$. For every incremental change in spacing between the web rolls, the flange roll adjacent line T28 is brought closer to the web portion in incremental steps n such that the depth T22 is further reduced from its original slab value $d_s$.

As the slab T12 is passed back and forth between the web and flange rolls, hot metal in area **26*b*, located in the regions extending between the broken line T28 and the outside edge surface T30, is forced to move in opposite directions away from the center plane T32 of the slab. As shown by arrow T33, the hot metal is forced in a direction so that the thickness of the slab area T26*b* exceeds the original slab thickness The web and flange rolls are further incrementally repositioned until the rolls produce a product having a web thickness $t_w$ and a flange thickness $t_f$, as shown in FIG. 6. Edging rolls (not shown) are used in later rolling stages to bring the flange width to the desired final value $b_f$. The edging rolls press on the flange tips in opposite directions, (as shown by the arrows 36 in FIG. 1** ) which are parallel to the forces exerted by the web rolls.

FIG. 6 illustrates nine incremental roll adjustments or steps used to roll a T-shape product from a slab as shown in FIG. 5. Again, this is only an example. The number of incremental steps may be greater or less than illustrated. The draft, (distance) between the roll set points is generally limited by the energy available in the mill where the shape is rolled.

After each of the nine incremental steps, the edge surface T30 of the slab T12 has been moved by compression of the slab to the positions indicated in FIG. 6 by the digit 1–8. Simultaneously, the upper and lower opposed surfaces **T26*a* within the web region determined by the width of the web rolls and defined in FIG. 5 by the broken lines T28*a* and T28, are compressed correspondingly to the dimensions illustrated in FIG. 6 by the numerals 1'–8' respectively. In the production of a T-shape section, the rolling actions are asymmetrical along the edge surfaces T30*a* and T30 and symmetrical on the upper and lower surfaces T26*a*. As the shaping progresses and the width dimension T22 of the slab is decreased from the original slab dimension $d_s$, hot material moves in two direction away from the slab center plane T32, as shown by directional arrow T33. Thus, the final contour of flange T14 is formed in incremental steps corresponding to the set points of the web and flange rolls which increasingly displace the flange areas 1"–8". The slab T12** makes a single pass through the rolls at each set point, and nine passes are made in the cited example.

After the nine illustrated passes are made between each roll set point, a finished T-shape product as shown in FIG. 6 is produced from the slab T12. The last set point for the web and flange rolls produce a web thickness $t_w$, a flange thickness $t_f$, and edging rolls (not shown) produce a flange width having a value $b_f$. The depth of the finished structural product is defined by the width of the web rolls that formed the web and by the thickness of the flange, and the roll set points for each pass are calculated similar to the above example given for the H-shape ranged product.

Figure 7:
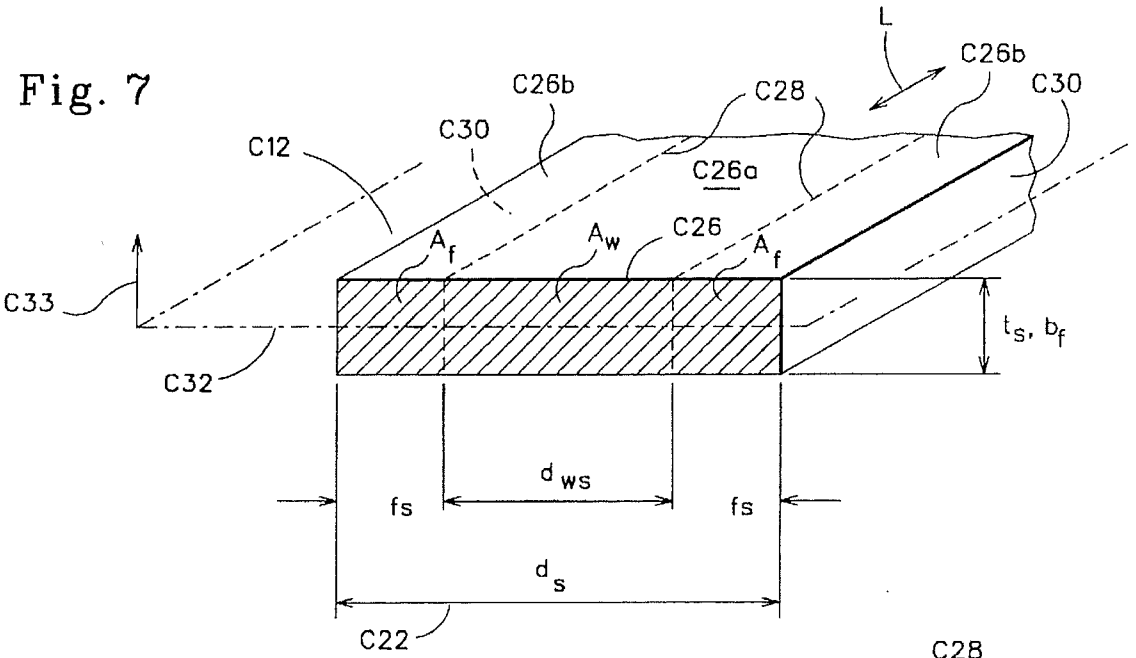
FIG. 7 is an oblique view similar to FIG. 2 showing a rectangular slab used in accordance with the method of the present invention to produce a finished channel or C-shape flanged product.

Still another example of a different ranged product capable of being produced using the steps of the present invention is shown in FIGS. 7 and 8. The figures show producing a channel or structural C-shape from a slab C12 having a selected slab length L, thickness $t_s$ and depth C22, also identified with an original slab depth value $d_s$ in FIG. 7.

As before, slab C12 is reheated to a rolling temperature in a reheat furnace prior to its insertion into a universal mill. The universal mill includes horizontal rolls, or we rolls, corresponding to the finished web depth $d_w$ of the C-shaped product. The web roll works the upper surface **C26*a* of the slab C12 in the web region defined between the broken lines C28. At the same time flange rolls work the slab edge surfaces C30 adjacent broken lines C28. The web portion of the slab, defined between the broken lines C28, is compressed by the web roll to an intermediate thickness less than the original slab thickness $t_s$, and at the same time the slab is reduced in its depth C22** from the original value $d_s$.

As the method proceeds, the spacing between the adjustable web rolls is reduced incrementally in steps n so that the intermediate slab thickness $t_n$ at its central portion **C26*a* is further reduced from the initial value $t_s$. For every incremental change in position of the web roll, the flange rolls are brought closer to the web portion in incremental steps n such that the width C22** is further reduced from its original value $d_s$.

As the slab C12 is passed back and forth between the web and flange rolls, hot metal in the areas **C26*b*, located in the regions extending between the broken lines C28 and the outside edge surfaces C30, is forced to move in opposite directions away from the center plane C32 of the slab. As shown by arrow C33, the hot metal is forced in a direction so that the thickness of the slab areas C26*b*** exceed the in process web thickness $t_n$.

The web and flange rolls are further incrementally repositioned until the rolls produce a finished C-shape product having a web thickness $t_w$ and a flange thickness $t_f$, as shown in FIG. 8. Edging rolls (not shown) are used to bring the flange width to the desired final value $b_f$, and to support and direct the spreading metal in an upward direction. The edging rolls press on the flange tips and web bottom in opposite directions, (as shown by the arrows 36 in FIG. 1) which are parallel to the forces exerted by the web rolls.

FIG. 8 illustrates nine incremental roll adjustments or steps used to roll a finished C-shape from a slab as shown in FIG. 7. Again, this is only an example. The number of incremental steps may be greater or less than illustrated. The draft (distance) between roll set points is generally limited by the energy available in the mill where the shape is rolled.

After each of the nine incremental steps, the opposite edge surfaces C30 of the slab C12 have been moved by compression of the slab to the positions indicated in FIG. 8 by the digits 1–8. Simultaneously, the upper surface C26*a*, within the web region C26*a* determined by the width of the web roll, is compressed correspondingly to the dimensions illustrated in FIG. 8 by the numerals 1'–8' respectively. And, at the same time, the bottom edger roll works the entire depth C22 to control localized hot material squeeze out along the bottom surface C26. In the production of a C-shape, the rolling actions are symmetrical along the edge surfaces C30, and may be asymmetrical on the upper and lower surfaces C26*a* and C26. As the shaping progresses and the slab depth C22 is decreased from the original slab depth $d_s$, and hot material moves in one direction away from the slab center plane C32, as shown by directional arrow C33. Thus, the final contour of the flanges C14 is formed in incremental steps corresponding to the roll set points of the flange rolls which increasingly displace the flange areas 1"–8". The slab C12 makes a single pass through the rolls at each set point, and nine passes are made in the cited example.

After the nine illustrated passes are made between each roll set point, a finished C-shape as shown in FIG. 8 is produced from the slab C12. The last set point for the web roll and flange rolls produce a web thickness $t_w$, a flange thickness $t_f$, and edging rolls (not shown) produce a flange width having a value $b_f$. The depth of the finished structural product was defined by the width of the web roll that formed the web and by the thickness of the flanges, and the roll set points for each pass are calculated similar to the above example given for the H-shape ranged product.

Thus, wide flange products are produced directly from rectangular slabs using only conventional rolling facilities, which may be limited to a universal mill and edge rolls. By adjusting the depth $d_s$ of the slab, a wide range of products can be produced from a given set of web rolls, where the finished products all have the same inner web depth 24. Facility requirements are reduced. Energy is conserved by single-heating of the work piece before the first rolling step and a high yield, low defect product is produced, ready for use in fabrication.

It will thus be seen that the objects set forth above, among those made apparent from the preceding description, are efficiently attained and, since certain changes may be made in carrying out the above method without departing from the spirit and scope of the invention, it is intended that all matter contained in the above description shall be interpreted as illustrative and not in a limiting sense.

I claim:

1. A method for producing a flanged product of predetermined dimensions and shape from a slab, said flanged product having a web to flange area ratio $A_w/A_f$, comprising the steps:

a) introducing directly into a universal mill a slab having a cross section thickness $t_s$ and a predetermined cross section depth $d_s$;

b) compressing between opposed web rolls in the universal mill a web portion of said slab to an intermediate thickness $t_n$, at least one web roll having a roll width equal to a web depth $d_w$ of said predetermined dimensions of said flanged product;

c) compressing by at least one flange roll in the universal mill, and substantially concurrently with step (b), said slab depth $d_s$ to an intermediate depth $d_n$, the at least one flange roll compressing flange portions of said slab located in regions not compressed by the opposed web rolls and causing said flange portions to extend in a direction substantially perpendicular to said web portion;

d) adjusting incrementally at least one of the opposed web rolls in a direction to reduce said intermediate thickness $t_n$;

e) adjusting incrementally the at least one flange roll in a direction to reduce said intermediate depth $d_n$;

f) compressing said slab simultaneously between the adjusted opposed web rolls and with the adjusted at least one flange roll to incrementally further reduce said intermediate thickness $t_n$, and to incrementally further reduce said intermediate depth $d_n$ and to further extend said flange portions in a direction substantially perpendicular to said web portion; and g) repeating steps (d), (e), and (f) in the universal mill until said slab is reduced to an intermediate thickness $t_n$ equal to a web thickness $t_w$ of said predetermined dimensions of said flanged product.

2. The method according to claim 1, further comprising the step:

h) passing between edger roll means in the universal mill said flange portions of said slab, the edger roll means shaping said flange portions to a final dimension corresponding to a flange width $b_f$ of said predetermined dimensions of said flanged product.

3. A method as in claim 2, wherein for each said incremental change in said slab of steps (b)–(h) the opposed web rolls and the at least one flange roll are adjusted to predetermined set points to provide an intermediate web portion to intermediate flange portion area ratio $A_{wn}/A_{fn}$ equal to said web to flange area ratio $A_w/A_f$ of said flanged product.

4. The method according to claim 3 wherein said slab passes in alternating directions through the opposed web rolls and the at least one flange roll.

5. The method according to claim 3, wherein the edger roll means acts on said slab at least during a final pass of said slab compressed between the opposed web rolls and the at least one flange roll.

6. The method according to claim 1 wherein for each said incremental change in said slab of steps (b)–(g) the opposed web rolls and the at least one flange roll are adjusted to predetermined set points to provide an intermediate web portion to intermediate flange portion area ratio $A_{wn}/A_{fn}$ equal to said web to flange area ratio $A_w/A_f$ of said flanged product.

7. The method according to claim 6 wherein said slab passes in alternating directions through the opposed web rolls and the at least one flange roll.

8. The method according to claim 1, wherein a single pass is made for each said incremental reduction in slab thickness and depth.

9. The method according to claim 1, wherein said slab of step (a) includes;

a) a starting slab thickness $\geqq 4t_w$, and b) a starting slab depth $d_s=(d_w)\ [1+2(A_w/A_f)^{-1}]$ where;

i) $A_w=(d_w)(t_w)$, and $A_f=(t_f)(b_f)$, and ii) $d_w$=a depth, and $b_f$=a flange width of said predetermined dimensions of said finished product.

10. The method according to claim 9 including;

a) selecting web roll set points for incrementally adjusting the opposed web rolls in a plurality of steps n, and b) calculating corresponding flange roll set points at each step n by determining an intermediate web area $A_{wn}=(t_{wn})(d_w)$ where;

i) $t_{wn}$=an intermediate web thickness for a step n, and c) using said $A_{wn}$ to calculate an intermediate flange area $A_{fn}$ at said step n, said $A_{fn}=A_{wn}(A_w/A_f)^{-1}$.

11. The method according to claim 10 wherein;

a) the flange roll set points are calculated for each the web roll set point such that $t_{fn}=A_{fn}/b_{fn}$, where;

i) $t_{fn}$ is an intermediate flange thickness and $b_{fn}$ is an intermediate flange width, and b) an intermediate web to flange area ratio $A_{wn}/A_{fn}$ at each said step n is maintained equal to a web to flange area ratio $A_w/A_f$ of said predetermined dimensions of said flanged product.

12. A method for producing a flanged product of predetermined dimensions and shape from a slab, said flanged product having a web to flange area ratio $A_w/A_f$, comprising the steps:

a) introducing directly into a universal mill a slab having a cross section thickness $t_s$ and a predetermined cross section depth $d_s$;

b) compressing between opposed web rolls in the universal mill a web portion of said slab to an intermediate thickness $t_n$, at least one web roll having a roll width equal to a web depth $d_w$ of said predetermined dimensions of said flanged product;

c) compressing by at least one flange roll in the universal mill, and substantially concurrently with step (b), said slab depth $d_s$ to an intermediate depth $d_n$, the at least one flange roll compressing flange portions of said slab located in regions not compressed by the opposed web rolls and causing said flange portions to extend in a direction substantially perpendicular to said web portion;

d) adjusting incrementally at least one of the opposed web rolls in a direction to reduce said intermediate thickness $t_n$, and compressing said slab with the opposed web rolls to incrementally further reduce said intermediate thickness $t_n$;

e) adjusting incrementally the at least one flange roll in a direction to reduce said intermediate depth $d_n$, and compressing said slab with the at least one flange roll to incrementally further reduce said intermediate depth $d_n$ and further extend said flange portions in a direction substantially perpendicular to said web portion; and f) repeating steps (d) and (e) until said intermediate thickness $t_n$ equals a web thickness $t_w$ of said predetermined dimensions of said flanged product.

13. The method according to claim 12, further comprising the step:

g) passing between edger roll means in the universal mill said flange portions of said slab, the edger roll means shaping said flange portions to a final dimension corresponding to a flange width $b_f$ of said predetermined dimensions of said flanged product.

14. The method according to claim 13 wherein for each said incremental change in said slab of steps (b)–(g) the opposed web rolls and said at least one flange roll are adjusted to predetermined set points to provide an intermediate web portion to flange portion area ratio $A_{wn}/A_{fn}$ equal to said web to flange area ratio $A_w/A_f$ of said flanged product.

15. The method according to claim 14 wherein said slab passes in alternating directions through the opposed web rolls and the at least one flange roll.

16. The method according to claim 14 wherein the edger roll means acts on said slab at least during a final pass of said slab compressed between the opposed web rolls and the at least one flange roll.

17. The method according to claim 12 wherein for each said incremental change in said slab of steps (b)–(f) the opposed web rolls and said at least one flange roll are adjusted to predetermined set points to provide an intermediate web portion to flange portion area ratio $A_{wn}/A_{fn}$ equal to said web to flange area ratio $A_w/A_f$ of said flanged product.

18. The method according to claim 17 wherein said slab passes in alternating directions through the opposed web rolls and the at least one flange roll.

19. The method according to claim 12 wherein a single pass is made for each said incremental reduction in slab thickness and depth.

20. The method according to claim 12 wherein said slab of step (a) includes;

a) a starting slab thickness $\geqq 4t_w$, and b) a starting slab depth $d_s=(d_w)[1+2(A_w/A_f)^{-1}]$ where;

Ahd $w=(d_w,)(t_w)$, and $A_f=(t_f)(b_f)$, and ii) $d_w$=a depth, and $b_f$=a flange width of said predetermined dimensions of said finished product.

21. The method according to claim 20 including;

a) selecting web roll set points for incrementally adjusting the opposed web rolls in a plurality of steps n, and b) calculating corresponding flange roll set points at each step n by determining an intermediate web area $A_{wn}=(t_{wn})(d_w)$ where;

i) $t_{wn}$=an intermediate web thickness for a step n, and c) using said $A_{wn}$ to calculate an intermediate flange area $A_{fn}$ at said step n, said $A_{fn}=A_{wn}(A_w/A_f)^{-1}$.

22. The method according to claim 21 wherein;

a) the flange roll set points are calculated for each the web roll set point such that $t_{fn}=A_{fn}/b_{fn}$, where;

i) $t_{fn}$ is an intermediate flange thickness and $b_{fn}$ is an intermediate flange width, and b) an intermediate web to flange area ratio $A_{wn}/A_{fn}$ at each said step n is maintained equal to a web to flange area ratio $A_w/A_f$ of said predetermined dimensions of said flanged product.

23. A method for producing a wide flange product of predetermined dimensions and shape from a preheated slab, said wide flange product having a predetermined area ratio of web to flanges $A_w/A_f$, comprising the steps:

a) introducing directly into a universal mill a preheated slab having extended length and having a cross section with a thickness $t_s$ and a predetermined width $d_s$;

b) passing said slab between a first pair of opposed rolls in the universal mill, the first pair of opposed rolls having a width less than said slab width $d_s$, said width of the first pair of rolls equalling an inside distance between said flanges of said wide flange product, the first pair of rolls compressing said slab thickness $t_s$ to an intermediate thickness $t_n$;

c) passing said slab substantially concurrently between a second pair of opposed rolls in the universal mill, a rotating axis of the first roll pair being at a right angle to a rotating axis of the second roll pair, the second roll pair compressing said slab width $d_s$ to an intermediate width $d_n$, portions of said slab, located in regions not compressed by the first roll pair, extending generally perpendicular to a direction of said passing of said slab between the rolls as a result of said compressings by the roll pairs;

d) incrementally moving at least a roll of each of the roll pairs to reduce a first spacing between the first pair of rolls and to reduce a second spacing between the second pair of rolls;

e) passing said slab simultaneously between the first and second pairs of rolls to incrementally further reduce said intermediate thickness $t_n$ and said intermediate width $d_n$;

f) repeating steps d) and e) until said intermediate thickness $t_n$ equals a web thickness $t_w$ of said predetermined dimensions of said wide flange product, and until simultaneously said intermediate width $d_n$ equals a depth d of said predetermined dimensions of said wide flange product.

24. A method as in claim 23, further comprising the step:

g) passing said portions of said slab which extend perpendicular to said direction of said passes between edger roll means in the universal mill, the edger roll means being positioned to act parallel to the first roll means for limiting said extending perpendicular portions, which are not compressed by the first roll means, to a final dimension corresponding to a flange width $h_f$ of said wide flange product of predetermined dimensions.

25. A method as in claim 24, wherein for each said incremental change in said slab of steps b)-g), a ratio of a cross sectional first area of said slab between said first pair of rolls, and a cross sectional second area of said slab between said second pair of rolls and said first area, equals $A_w/A_f$.

26. A method as in claim 25, wherein said slab cross section of step a) is generally rectangular.

27. A method as in claim 23, wherein for each said incremental change in said slab of steps b)–f), the roll spacings provide a ratio of a cross sectional first area of said slab, said first area being located between the first pair of rolls, and a cross sectional second area of said slab located between the second pair of rolls, said second area being exclusive of said first area, equal to $A_w/A_f$.

28. A method as in claim 27, wherein said slab cross section of step a) is generally rectangular.

29. A method as in claim 28, wherein said passes alternate in direction through the first and second roll pairs.

30. A method as in claim 26, wherein said passes alternate in direction through the first and second roll pairs.

31. A method as in claim 26, wherein the edger roll means acts on said slab at least during a final pass of said compressed slab between the first and second roll pairs.

32. A method as in claim 23, wherein a single pass is made for each said incremental reduction in slab thickness and depth.

33. A method as in claim 23, wherein said slab cross section of step a) is calculated by equations $$d_s=(d-2t_f)[1+2(A_w/A_f)^{-1}] \text{ and}$$

where d=depth of the finished wide flange product $t_f$=thickness of the finished flange $t_w$=thickness of the finished web, and $A_w=(d-2t_f)(tw)$ $A_f=h_f t_f$.

34. A method as in claim 33 wherein after set points for the horizontal roll pair are selected, corresponding points for the vertical roll pair are calculated at each step n by determining an intermediate web area $A_{wn}$ that equals $t_{wn}(d-2t_f)$, $t_{wn}$ being an intermediate web thickness, and using the calculated value of $A_{wn}$ in further calculating a corresponding intermediate flange area as $A_{fn}=A_{wn}(A_w/A_f)^{-1}$.

35. A method as in claim 34 wherein set points are calculated for the vertical rolls for each said set point of the horizontal rolls such that $t_{fn}=A_{fn}/h_{fn}$, where $t_{fn}$ is the intermediate flange thickness and $h_{fn}$ is the intermediate flange width, and $A_{wn}/A_{fn}$ is maintained equal to $A_w/A_f$.

36. A method for producing a wide flange product having a web and flanges, comprising the steps:

a) introducing directly into a universal mill a preheated slab having extended length, a cross section thickness $t_s$ and a cross section width $d_s$;

b) passing said slab between a first pair of opposed rolls within the universal mill, the first pair of opposed rolls having a width less than said slab width $d_s$ and approximately equalling an inside distance between said flanges of said wide flange product, the first pair of rolls compressing said slab thickness $t_s$ to an intermediate thickness $t_n$;

c) passing said slab concurrently between a second pair of opposed rolls within the universal mill, a rotating axis of the first roll pair being at a right angle to a rotating axis of the second roll pair, the second roll pair compressing said slab width $d_s$ to an intermediate width $d_n$, portions of said slab, located in regions not compressed by the first roll pair, extending generally perpendicular to a direction of said passing of said slab between the rolls as a result of said compressing by the roll pairs;

d) incrementally moving at least a roll of each of the roll pairs to reduce a first spacing between the first pair of rolls and to reduce a second spacing between the second pair of rolls;

e) passing said slab simultaneously between the first and second pairs of rolls to incrementally further reduce said intermediate thickness $t_n$ and said intermediate width $d_n$.

37. The method of claim 36, further comprising the step:

f) repeating steps (d) and (e) until said intermediate thickness $t_n$ equals a web thickness $t_w$ of said wide flange product, and until simultaneously said intermediate width $d_n$ equals a depth d of said wide flange product.

38. A method as in claim 37, further comprising the step:

g) passing said portions of said slab, which extend perpendicular to said direction of said passes, between edger roll means within the universal mill, the edger roll means being positioned to act parallel to the first roll means for limiting said extending perpendicular portions, which are not compressed by the first roll means, to a final dimension corresponding to a flange width $h_f$ of said wide flange product.

39. A method as in claim 36, wherein said slab cross section is rectangular.

40. A method as in claim 36, wherein for each said incremental change in said slab of steps (b)–(f), said roll spacings provide a ratio equal to $A_w/A_f$ of a cross sectional first area of said slab, said first area being located between the first pair of rolls, and a cross sectional second area of said slab located between the second pair of rolls, said second area being exclusive of said first area, $A_w$ being the web area of said wide flange product and $A_f$ being the flange area of said wide flange product.

* * * * *